US006008178A

United States Patent [19]

Baillely et al.

[11] Patent Number: 6,008,178

[45] Date of Patent: Dec. 28, 1999

[54] DETERGENT COMPOSITION COMPRISING CATIONIC ESTER SURFACTANT AND PROTEASE ENZYME

[75] Inventors: Gerard Marcel Baillely; Robin Gibson Hall; Christian Leo Marie Vermote, all of Newcastle upon Tyne, United Kingdom

[73] Assignee: Procter & Gamble Company, Cincinnati, Ohio

[21] Appl. No.: 08/973,922

[22] PCT Filed: Jul. 3, 1996

[86] PCT No.: PCT/US96/11249

§ 371 Date: Dec. 22, 1997

§ 102(e) Date: Dec. 22, 1997

[87] PCT Pub. No.: WO97/03156

PCT Pub. Date: Jan. 30, 1997

[30] Foreign Application Priority Data

Jul. 8, 1995 [GB] United Kingdom ..... 9513999

[51] Int. Cl.[6] ..... C11D 3/386; C11D 1/46

[52] U.S. Cl. ..... 510/392; 510/226; 510/321; 510/340; 510/351; 510/504; 510/530

[58] Field of Search ..... 510/226, 321, 510/340, 351, 392, 504, 530

[56] References Cited

U.S. PATENT DOCUMENTS

| | | | |
|---|---|---|---|
| 4,228,042 | 10/1980 | Letton | 252/528 |
| 4,239,660 | 12/1980 | Kingry | 252/528 |
| 4,259,215 | 3/1981 | Murata et al. | 252/528 |
| 4,260,529 | 4/1981 | Letton | 252/547 |
| 4,321,157 | 3/1982 | Harris et al. | 252/174.25 |
| 4,321,165 | 3/1982 | Smith et al. | 252/528 |
| 5,030,377 | 7/1991 | Sone et al. | 252/174.12 |
| 5,565,420 | 10/1996 | Stearns | 510/358 |

*Primary Examiner*—Kery Fries
*Attorney, Agent, or Firm*—C. Brant Cook; Kim W. Zerby; Jacobus C. Rasser

[57] ABSTRACT

There is provided a detergent composition comprising: a) from 1% to 95% by weight of a surfactant system comprising an anionic surfactant and a cationic ester surfactant, other than N,N-di(2-stearoyloxyethyl)-N-(2-hydroxyethyl)-N-methyl ammonium chloride, present in a weight ratio of said anionic surfactant to said cationic ester surfactant of 2.5:1 to 25:1; and b) from 0.0001% to 5% by weight of a proteolytic enzyme, wherein the % weight of proteolytic enzyme in the formulation is based on an enzyme activity of 4 Knpu/g of the enzyme particle, and wherein the weight ratio of said anionic surfactant to said proteolytic enzyme is at least 1.5:1.

17 Claims, No Drawings

DETERGENT COMPOSITION COMPRISING CATIONIC ESTER SURFACTANT AND PROTEASE ENZYME

FIELD OF THE INVENTION

The present invention relates to detergent compositions adapted for use in laundry and dish washing processes. More specifically, the present invention relates to detergent compositions comprising a surfactant system in combination with a proteolytic enzyme which provide unexpectedly good detergency performance on proteinaceous soils.

BACKGROUND OF THE INVENTION

The satisfactory removal of soils/stains is a particular challenge to the formulator of a detergent composition for use in laundry and dishwashing machines.

Traditionally, the removal of soils/stains has been facilitated by the use of surfactants. Of these, anionic surfactants have been found to give the most effective cleaning performance, especially at high levels.

Additional cleaning benefits may also be seen with the use of enzymes, for example, in the removal of proteinaceous stains/soils such as blood, egg, chocolate, gravy and the like.

A problem encountered with the use of enzymes as components of detergents is that enzyme activity in the wash may be reduced by the presence of other detergent components in the wash solution such as high levels of anionic surfactants.

One solution to this problem would be to reduce the level of anionic surfactant present in the detergent composition. However, whilst this would ameliorate the problem, this is accompanied by a marked negative effect on the overall stain/soil removal performance. To overcome this problem, combinations of surfactants, such as anionic, nonionic and cationic surfactants have been used.

GB-1,375,450 discloses a detergent composition which is asserted to provide effective cleaning and soil removal performance. The composition comprises an anionic surfactant, a cationic surfactant together with a proteolytic enzyme, wherein said cationic surfactant comprises two hydrophobic long chains. Specifically disclosed as suitable cationic surfactants are alkyl quaternary ammonium species as well as the ester compound formed from two moles of stearic acid and one mole of triethanol-methyl-ammonium chloride, e.g. N,N-di(2-stearoyloxyethyl)-N-(2-hydroxyethyl)-N-methyl ammonium chloride. However, a problem encountered with such cationic surfactants is their relative insolubility in the wash which diminishes their value in detergent compositions.

EP-B-8142 discloses liquid detergent compositions comprising a ternary surfactant system containing anionic, nonionic and cationic surfactants. More particularly disclosed is a liquid composition comprising 24% of an anionic surfactant (LAS), 18.5% of a nonionic surfactant ($C_{45}E7$) and 3.5% of Coconut ($C_{12}$–$C_{14}$) dihydroxyethylmethyl ammonium chloride together with 0.4% of a Maxatase proteolylic enzyme, and wherein said composition is asserted to provide good soil removal performance.

EP-B-51986 discloses a granular laundry detergent composition which is asserted to provide good grease and oil removal performance together with clay soil detergency. The composition comprises, as a surfactant system a specified mixture of anionic, nonionic and water-soluble $C_{10}$–$C_{14}$ alkyl trimethyl quaternary ammonium cationic surfactant, wherein said cationic surfactant is in amount from 0.2% to 2% by weight. The composition may additionally comprise a proteolytic enzyme.

Another potential solution to these problems would be to use detergent particles with different solubility rates. However, this would greatly increase the cost of the manufacturing process. An exemplary disclosure is given in EP-A-0,342,043 where the anionic surfactant and the enzyme are in two different particulate multi ingredient components. The particulate containing the enzyme has a solubility rate superior to the surfactant particulate and this superior solubility rate may be provided by a cationic surfactant.

Notwithstanding the advances in the art represented by the above disclosures, there is still a need for detergent compositions which provide effective soil/stain removal performance, which avoid degradation of the detergent components and which are not detrimental to the environment.

The Applicant has now surprisingly found that the provision of a cationic ester surfactant ameliorates these problems. Not to be bound by theory, it is believed that such component reduces the critical micelle concentration of any anionic surfactant present in the composition. Hence, reducing the concentration of anionic surfactant monomers in the wash improves the enzyme performance. Further enhanced soil removal benefits are observed where the cationic ester surfactant contains one hydrophobic chain.

The Applicant has also found that where a detergent composition contains a surfactant system comprising an anionic surfactant and a cationic ester surfactant, in combination with a proteolytic enzyme enhanced stain/soil removal is obtained, especially on proteinaceous stains.

The Applicant has found that the further addition of an amylolytic enzyme to the composition of the present invention enhances the overall soil/stain removal performance.

It is therefore an object of the present invention to provide compositions suitable for use in laundry and machine dishwashing methods producing enhanced stain removal.

SUMMARY OF THE INVENTION

According to the present invention there is provided a detergent composition comprising:

a)—from 1% to 95% by weight of a surfactant system comprising an anionic surfactant and a cationic ester surfactant, other than N,N-di(2-stearoyloxyethyl)-N-(2-hydroxyethyl)-N-methyl ammonium chloride, present in a weight ratio of said anionic surfactant to said cationic ester surfactant of 2.5:1 to 25:1; and b)—from 0.0001% to 5% by weight of a proteolytic enzyme, wherein the % weight of proteolytic enzyme in the formulation is based on an enzyme activity of 4 KNPU/g of the enzyme particle, and wherein the weight ratio of said anionic surfactant to said proteolytic enzyme is at least 1.5:1.

If the actual activities of these proteolytic enzymes in the detergent composition are different from their 4 KNPU/g standard activities, the level of proteolytic enzyme will be adjusted accordingly. Non limiting examples of enzymes which can be used for the purpose of the invention include Savinase, enzyme of the Bacillus Lentus type backbone such as Maxacal, Opticlean, Durazym and Properase, enzyme of the Bacillus Licheniformis type backbone such as Alcalase and Maxatase and enzyme of the Bacillus Amyloliquefaciens type backbone such as Primase. For example, if a protease is used having an activity of 16 knpu/g, the amount of protease will be reduced by a factor 4 to compensate for the extra activity of the protease.

For the purpose of the invention, proteases which are not supplied in Knpu/g units will also be converted according to the process described below so as to obtain uniform enzyme unit and enzyme activity, e.g 4 Knpu/g:

1—conversion of the level of proteolytic enzyme used into the level of pure enzyme, and 2—conversion from the level of pure enzyme to a 4 knpu/g Savinase particle basis according to the following equation:

4 knpu/g=16.5 mg pure enzyme/g of enzyme particle

For example, according to the process described above, Alcalase of 1.25 AU/g is found to be equivalent to 4 Knpu/g.

In a preferred embodiment, the cationic ester surfactant is a water-dispersible surfactant selected from those having the formula:

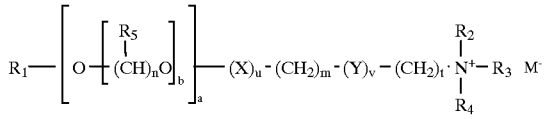

wherein $R_1$ is a $C_5$–$C_{31}$ linear or branched alkyl, alkenyl or alkaryl chain or $M^-$. $N^+(R_6R_7R_8)(CH_2)_s$; X and Y, independently, are selected from COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$, and $R_8$ are independently selected from alkyl, alkenyl, hydroxyalkyl, hydroxyalkenyl and alkaryl groups having from 1 to 4 carbon atoms; and $R_5$ is independently H or a $C_1$–$C_3$ alkyl group; wherein the values of m, n, s and t independently lie in the range of from 0 to 8, the value of b lies in the range from 0 to 20, and the values of a, u and v independently, are either 0 or 1 with the proviso that at least one of u or v must be 1; and wherein M is a counter anion.

Preferred water-dispersible cationic ester surfactants are the choline ester surfactants.

DETAILED DESCRIPTION OF THE INVENTION

An essential element of the invention is a surfactant system present in amount from 1% to 95%, preferably from 3% to 50%, more preferably 4% to 40% and most preferably from 5% to 30% by weight of the detergent composition. Said system comprises as essential components an anionic surfactant and a cationic ester surfactant.

The weight ratio of said anionic surfactant to said cationic ester surfactant in the surfactant system is from 2.5:1 to 25:1, preferably from 4:1 to 15:1, most preferably from 5:1 to 10:1.

Anionic Surfactant

Essentially any anionic surfactants useful for detersive purposes can be included in the compositions. These can include salts (including, for example, sodium, potassium, ammonium, and substituted ammonium salts such as mono-, di- and triethanolamine salts) of the anionic sulfate, sulfonate, carboxylate and sarcosinate surfactants and mixtures thereof.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleyl glycerol sulfates, alkyl phenol ethylene oxide ether sulfates, the $C_5$–$C_{17}$ acyl-N-($C_1$–$C_4$ alkyl) and -N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the $C_6$–$C_{18}$ alkyl sulfates which have been ethoxylated with from about 0.5 to about 20 moles of ethylene oxide per molecule. More preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein.

Preferred alkyl ethoxy carboxylates for use herein include those with the formula $$RO(CH_2CH_2O)_x\ CH_2COO^-M^+$$

wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula RO—($CHR_1$—$CHR_2$—O)—$R_3$ wherein R is a $C_6$ to $C_{18}$ alkyl group, x is from 1 to 25, $R_1$ and $R_2$ are selected from hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from hydrogen, substituted or unsubstituted hydrocarbon having between 1 and 8 carbon atoms, and mixtures thereof.

Anionic Secondary Soap Surfactant

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $$R^3\ CH(R^4)COOM,$$

wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $$R^5\text{–}R^6\text{—}COOM,$$

wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $$CH_3(CHR)_k\text{—}(CH_2)_m\text{—}(CHR)_n\text{—}CH(COOM)(CHR)_o\text{—}(CH2)_p\text{—}(CHR)_q\text{—}CH_3,$$

wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Alkali Metal Sarcosinate Surfactant

Other suitable anionic surfactants are the alkali metal sarcosinates of formula $$R\text{-}CON\ (R^1)\ CH_2\ COOM,$$

wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Cationic Ester Surfactant

An essential component of the surfactant system is a water dispersible cationic ester surfactant. That is, a water dispersible compound having surfactant properties comprising at least one ester (is —COO—) linkage and at least one cationically charged group.

Excluded from the cationic ester surfactant species of the invention is the ester compound formed from two moles of stearic acid and one mole of triethanol-methyl-ammonium chloride, e.g. N,N-di(2-stearoyloxyethyl)-N-(2-hydroxyethyl)-N-methyl ammonium chloride.

Suitable cationic ester surfactants, including choline ester surfactants, have for example been disclosed in U.S. Pat. Nos. 4,228,042, 4,239,660 and 4,260,529.

Preferred water dispersible cationic ester surfactants are those having the formula:

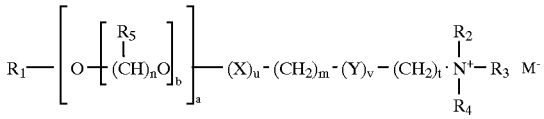

wherein $R_1$ is a $C_5$–$C_{31}$ linear or branched alkyl, alkenyl or alkaryl chain or $M^-$. $N^+(R_6R_7R_8)(CH_2)_s$; X and Y, independently, are selected from COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$, and $R_8$ are independently selected from alkyl, alkenyl, hydroxyalkyl, hydroxyalkenyl and alkaryl groups having from 1 to 4 carbon atoms; and $R_5$ is independently H or a $C_1$–$C_3$ alkyl group; wherein the values of m, n, s and t independently lie in the range of from 0 to 8, the value of b lies in the range from 0 to 20, and the values of a, u and v independently, are either 0 or 1 with the proviso that at least one of u or v must be 1; and wherein M is a counter anion.

Preferably $R_2$,$R_3$ and $R_4$ are independently selected from $CH_3$ and —$CH_2CH_2OH$.

Preferably M is selected from halide, methyl sulfate, sulfate, and nitrate, more preferably methyl sulfate, chloride, bromide or iodide.

Preferred water dispersible cationic ester surfactants are the choline esters having the formula:

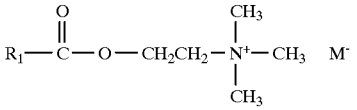

wherein $R_1$ is a $C_{11}$–$C_{19}$ linear or branched alkyl chain.

Particularly preferred choline esters of this type include the stearoyl choline ester quaternary methylammonium halides ($R^1$=$C_{17}$ alkyl), palmitoyl choline ester quaternary methylammonium halides ($R^1$=$C_{15}$ alkyl), myristoyl choline ester quaternary methylammonium halides ($R^1$=$C_{13}$ alkyl), lauroyl choline ester methylammonium halides ($R^1$=$C_{11}$ alkyl), cocoyl choline ester quaternary methylammonium halides ($R^1$=$C_{11}$–$C_{13}$ alkyl), tallowyl choline ester quaternary methylammonium halides ($R^1$=$C_{15}$–$C_{17}$ alkyl), and any mixture thereof.

Most preferred choline ester compounds among the above disclosed are cocoyl choline ester quaternary methylammonium halides.

The particularly preferred choline esters, given above, may be prepared by the direct esterification of a fatty acid of the desired chain length with dimethylaminoethanol, in the presence of an acid catalyst. The reaction product is then quaternized with a methyl halide, forming the desired cationic material. They may also be prepared by the direct esterification of a long chain fatty acid of the desired chain length together with 2-haloethanol, in the presence of an acid catalyst material. The reaction product is then quaternized with trimethylamine, forming the desired cationic material.

Other suitable cationic ester surfactants have the structural formulas below, wherein d may be from 0 to 20.

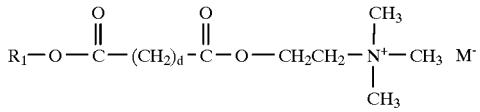

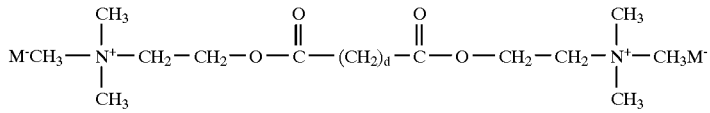

Preferably, the cationic ester surfactant is present in amount from 1% to 20%, preferably 4% to 15% and more preferably 5% to 12% by weight of the surfactant system.

Proteolytic Enzyme

An essential component of the detergent composition is an enzyme showing proteolytic activity.

For the purpose of the invention, the level of proteolytic enzyme in the formulation is based on an enzyme activity of 4 Knpu/g of the enzyme particle.

The compositions herein will typically comprise from 0.0001% to 5%, preferably from 0.001% to 4% and more preferably from 0.005% to 2% active protease by weight of the composition.

The weight ratio of said anionic surfactant to said proteolytic enzyme is at least 1.5:1, preferably at least 3:1 and more preferably at least 5:1.

Suitable enzymes, for the purpose of the invention, have for example been disclosed in U.S. Pat. Nos. 3,519,570 and 3,533,139.

Non limiting examples of proteolytic enzymes which can be used for the purpose of the invention include Savinase, enzyme of the *Bacillus lentus* type backbone such as Maxacal, Opticlean, Durazym and Properase, enzyme of the *Bacillus licheniformis* type backbone such as Alcalase and Maxatase and enzyme of the *Bacillus amyloliquefaciens* type backbone such as Primase.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Mixture of the herein before described proteases may be used.

A most preferred protease is Savinase.

The detergent composition of the invention has further been found to produce an enhanced soil removal performance in presence of one or more additional enzymes selected from amylase, cellulase, lipase, peroxidase, endoglucanase enzymes and mixtures thereof, preferably amylase enzymes.

These enzymes may be incorporated into the composition in accordance with the invention at a level of 0.0001% to 5% active enzyme by weight of the composition.

Preferred amylases usable in the present invention include, for example, α-amylases obtained from a special strain of *B licheniformis*, described in more detail in GB-1, 269,839 (Novo). Preferred commercially available amylases include for example, those sold under the tradename Rapidase by Gist-Brocades, and those sold under the tradename Termamyl and BAN by Novo Industries A/S. The cellulases usable in the present invention include both bacterial or fungal cellulase. Preferably, they will have a pH optimum of between 5 and 9.5. Suitable cellulases are disclosed in U.S. Pat. No. 4,435,307, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. ENDO A, CAREZYME both from Novo Industries A/S are especially useful.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, lipases ex *Pseudomonas gladioli*. Also suitable are cutinases [EC 3.1.1.50] which can be considered as a special kind of lipase, namely lipases which do not require interfacial activation. Addition of cutinases to detergent compositions have been described in e.g. EP-B-0,322,429 (Genencor) and EP-A-0,652,939 (Unilever).

The LIPOLASE enzyme derived from *Humicola lanuginosa* and commercially available from Novo (see also EP 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in EP-A-0,424,398.

A wide range of enzyme materials and means for their incorporation into synthetic detergent compositions are also disclosed in U.S. Pat. No. 3,553,139. Enzymes are further disclosed in U.S. Pat. No. 4,101,457 and in U.S. Pat. No. 4,507,219. Enzyme materials useful for liquid detergent formulations, and their incorporation into such formulations, are disclosed in U.S. Pat. No. 4,261,868. Enzymes for use in detergents can be stabilized by various techniques. Enzyme stabilisation techniques are disclosed and exemplified in U.S. Pat. No. 3,600,319 and EP 0 199 405. Enzyme stabilisation systems are also described, for example, in U.S. Pat. No. 3,519,570.

Optionally, the surfactant system may further comprises additional surfactants which are not detrimental to the system. Such surfactants may include nonionic, ampholytic, amphoteric, zwitterionic, and non-ester cationic surfactants and mixtures thereof.

Additional Surfactant

The additional surfactant is preferably present at a level from 0.1% to 50%, more preferably from 1% to 40%, most preferably from 5% to 30% by weight of the surfactant system.

A typical listing of nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Nonionic Surfactant

Essentially any anionic surfactants useful for detersive purposes can be included in the compositions. Exemplary, non-limiting classes of useful nonionic surfactants are listed below.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy group or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

Nonionic Ethoxylated Alcohol Surfactant

The alkyl ethoxylate condensation products of aliphatic alcohols with from about 0 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)t(\text{glycosyl})_x$$

wherein $R^2$ is selected from alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably 0, and X is from 1.3 to 8, preferably from 1.3 to 3, most preferably from 1.3 to 2.7. The glycosyl is preferably derived from glucose.

Nonionic Fatty Acid Amide Surfactant

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from hydrogen, $C_1$–$C_4$ alkyl, $C_1$–$C_4$ hydroxyalkyl, and —$(C_2H_4O)_xH$, where x is in the range of from 1 to 3.

Amphoteric Surfactant

Suitable amphoteric surfactants for use herein include the amine oxide surfactants and the alkyl amphocarboxylic acids. A suitable example of an alkyl aphodicarboxylic acid for use herein is Miranol™ C2M Conc. manufactured by Miranol, Inc., Dayton, N.J.

Amine Oxide Surfactant

Amine oxides useful herein include those compounds having the formula $R^3(OR^4)_xNO(R^5)_2$ wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include dimethyloctylamine oxide, diethyidecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Betaine Surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Sultaine Surfactant

The sultaines useful herein are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Ampholytic Surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched.

Non-ester Cationic Surfactants

Non ester cationic surfactants can also be used in the detergent compositions herein. Suitable non ester cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Optionally, the detergent composition of the invention may further comprises additional components which are not detrimental to the composition. Such components include builders, chelants, alkaline hydrogen peroxide sources, peroxyacid bleach precursors, polymeric dispersing agents and conventional detersive adjuncts.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Granular formulations typically comprise from 10% to 80%, more typically from 15% to 50% by weight, of the detergent builder. Lower or higher levels of builder, however, are not meant to be excluded.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates).

Non-phosphate builders may also be used. These can include, but are not restricted to phytic acid, silicates, alkali metal carbonates (including bicarbonates and sesquicarbonates), sulphates, aluminosilicates, monomeric polycarboxylates, homo or copolymeric polycarboxylic acids or their salts in which the polycarboxylic acid comprises at least two carboxylic radicals separated from each other by not more than two carbon atoms. Examples of silicate builders are the crystalline layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilising agent for oxygen bleaches, and as a component of suds control systems.

Aluminosilicate builders are especially useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 and U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. No. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, or acrylic acid, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions containing the present invention are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP 0,200,263.

Other suitable polycarboxylates are disclosed in U.S. Pat. No. 4,144,226 and in U.S. Pat. No. 3,308,067. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Chelants

Chelating agents generally comprise from 0.1% to 10% by weight of the compositions herein. More preferably, if utilized, the chelating agents will comprise from 0.1% to 3.0% by weight of such compositions.

A chelating agent can be selected from amino carboxylate, organic phosphonate, polyfunctionally-substituted aromatic compound, nitriloacetic acid and mixture thereof. Without intending to be bound by theory, it is believed that the benefit of these materials is due in part to their exceptional ability to remove transition metal ions such as iron and manganese ions from washing solutions by formation of soluble chelates.

Amino carboxylates useful as optional chelating agents include ethylenediaminetetracetates, ethylenediamine disuccinate, N-hydroxyethylethylenediaminetriacetates, 2-hydroxypropylene diamine disuccinate, nitrilotriacetates, ethylenediamine tetraproprionates, triethylenetetraaminehexacetates, ethylene triamine pentaacetate, diethylenetriaminepentaacetates, and ethanoldiglycines, alkali metal, ammonium, and substituted ammonium salts therein and mixtures therein. Preferred amino carboxylates chelants for use herein are ethylenediamine disuccinate ("EDDS"), especially the [S,S] isomer as described in U.S. Pat. No. 4,704,233, ethylenediamine-N, N'-diglutamate (EDDG) and 2-hydroxypropylene-diamine-N,N'-disuccinate (HPDDS) compounds. A most preferred amino carboxylate chelant is ethylenediamine disuccinate.

Organic phosphonates are also suitable for use as chelating agents in the compositions of the invention when at least low levels of total phosphorus are permitted in detergent compositions, and include ethylenediaminetetrakis (methylenephosphonates) available under the trademark DEQUEST from Monsanto, diethylene triamine penta (methylene phosphonate), ethylene diamine tri (methylene phosphonate), hexamethylene diamine tetra (methylene phosphonate), α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethane 1,1 diphosphonate.

Preferably, these amino phosphonates do not contain alkyl or alkenyl groups with more than 6 carbon atoms.

Preferred chelants are the diphosphonate derivatives selected from α-hydroxy-2 phenyl ethyl diphosphonate, methylene diphosphonate, hydroxy 1,1-hexylidene, vinylidene 1,1 diphosphonate, 1,2 dihydroxyethane 1,1 diphosphonate and hydroxy-ethane 1,1 diphosphonate. A most preferred is hydroxy-ethane 1,1 diphosphonate.

Polyfunctionally-substituted aromatic chelating agents are also useful in the compositions herein. See U.S. Pat. No. 3,812,044. Preferred compounds of this type in add form are dihydroxydisulfobenzenes such as 1,2-dihydroxy-3,5-disulfobenzene.

Alkaline Hydrogen Peroxide Sources

Detergent compositions of the present invention may include an inorganic perhydrate bleach, normally in the form of the sodium salt, as the source of alkaline hydrogen peroxide in the wash liquor. This perhydrate is normally incorporated at a level of from 1% to 40% by weight, more preferably from 5% to 35% by weight and most preferably from 8% to 30% by weight of the composition.

The perhydrate may be any of the alkali metal inorganic salts such as perborate monohydrate or tetrahydrate, percarbonate, perphosphate and persilicate salts, but is conventionally an alkali metal perborate or percarbonate.

Sodium percarbonate, which is the preferred perhydrate, is an addition compound having a formula corresponding to $$2Na_2CO_3.3H_2O_2,$$

and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borosilicate borate, boric acid and citrate or sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The particle size range of the crystalline percarbonate is from 350 micrometers to 1500 micrometers with a mean of approximately 500–1000 micrometers.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

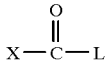

where L is a leaving group and X is essentially any functionality, such on perhydrolysis the structure of the peroxyacid produced is

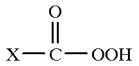

Peroxyacid bleach precursor compounds are preferably incorporated at a level of from 0.1% to 60% by weight, more preferably from 0.5% to 40% by weight of the detergent composition.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

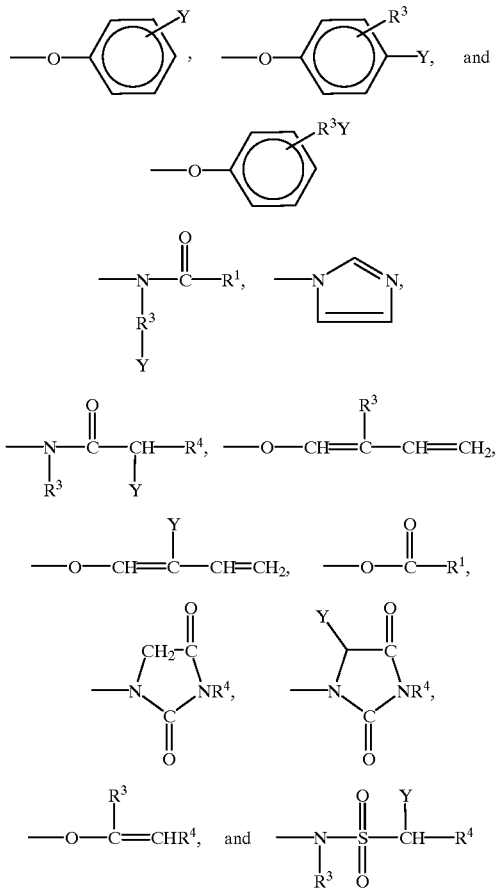

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group induding, for example alkyl, hydroxy, alkoxy, halogen, amine, nitrosyl, amide and ammonium or alkyl ammonium groups The preferred solubilizing groups are $—SO_3^-M^+$, $—CO_2^-M^+$, $—SO_4^-M^+$, $—N^+(R^3)_4X^-$and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Suitable peroxyacid bleach precursor materials are compounds containing one or more N- or O-acyl groups. These can be selected from a wide range of classes that include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Detergent compositions containing mixtures of any of the precursors hereinafter disclosed are also contemplated by the present invention.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

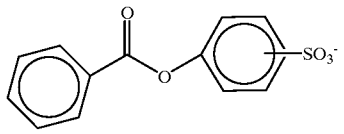

Also suitable are the benzoylation products of sorbitol, glucose, and all saccharides with benzoylating agents, including for example:

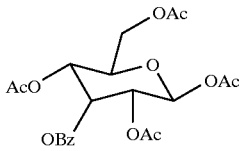

Ac = COCH3; Bz = Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

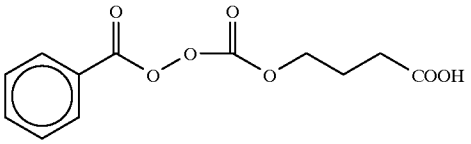

Phthalic anhydride is another suitable perbenzoic acid precursor compound herein:

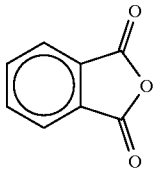

Suitable N-acylated precursor compounds of the lactam class are disclosed generally in GB-A-855735.

Suitable caprolactam bleach precursors which may be used herein are of the formula:

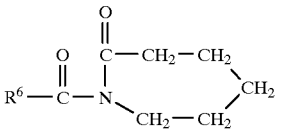

wherein $R^6$ is H or an alkyl, aryl, alkoxyaryl or alkaryl group containing from 1 to 12 carbon atoms, preferably from 6 to 12 carbon atoms.

Suitable valero lactams have the formula:

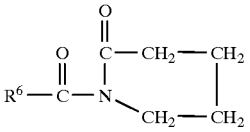

wherein $R^6$ is H or an alkyl, aryl, alkoxyaryl or alkaryl group containing from 1 to 12 carbon atoms, preferably from 6 to 12 carbon atoms. In highly preferred embodiments, $R^6$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino alkyl, alkyl, aryl and alkyloxy derivatives.

Caprolactam and valerolactam precursor materials wherein the $R^6$ moiety contains at least 6, preferably from 6 to about 12, carbon atoms provide peroxyacids on perhydrolysis of a hydrophobic character which afford nucleophilic and body soil clean-up. Precursor compounds wherein $R^6$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1 :1, can be used herein for mixed stain removal benefits.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (ie; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

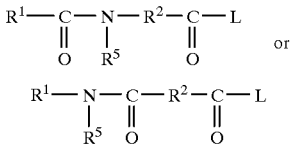

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

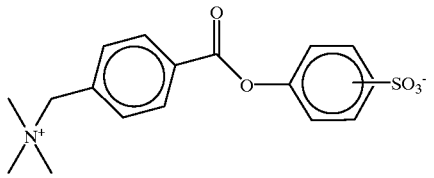

A preferred cationically substituted alkyl oxybenzene sulfonate has the formula:

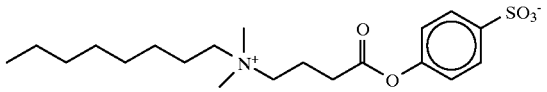

Preferred cationic peroxyacid precursors of the N-acylated caprolactam class include the trialkyl ammonium methylene benzoyl caprolactams, particularly trimethyl ammonium methylene benzoyl caprolactam:

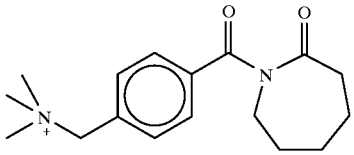

Other preferred cationic peroxyacid precursors of the N-acylated caprolactam class include the trialkyl ammonium methylene alkyl caprolactams:

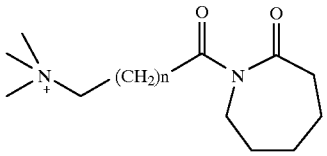

where n is from 0 to 12.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-trimethyl hexanoyloxybenzene sulfonate (ISONOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are also suitable, including those of the following general formulae:

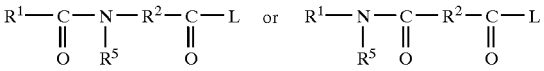

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

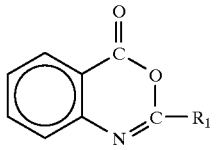

including the substituted benzoxazins of the type

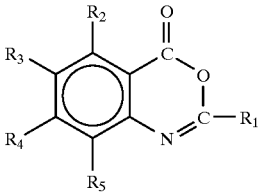

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

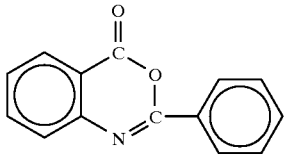

Bleaching agents other than oxygen bleaching agents are also known in the art and can be utilized herein. One type of non-oxygen bleaching agent of particular interest includes photoactivated bleaching agents such as the suffonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. 549,271A1, 549,272A1, 544,440A2, and 544,490A1; Preferred examples of these catalysts include $Mn^{IV}{}_2(u\text{-}O)_3$(1,4,7-trimethyl-1,4,7-triazacylononane)$_2(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)- $(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084;

As a practical matter, and not by way of limitation, the compositions and processes herein can be adjusted to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

Polymeric Dispersing Agents—Polymeric dispersing agents can advantageously be utilized at levels from 0.5% to 8%, by weight, in the compositions herein, especially in the presence of zeolite and/or layered silicate builders. Suitable polymeric dispersing agents include polymeric polycarboxylates and polyethylene glycols, although others known in the art can also be used.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates are selected from acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Polymeric polycarboxylate materials can also optionally include further monomeric units such as nonionic spacing units. For example, suitable nonionic spacing units may include vinyl alcohol or vinyl acetate.

Particularly preferred polymeric polycarboxylates are co-polymers derived from monomers of acrylic acid and maleic acid. The average molecular weight of such polymers in the acid form preferably ranges from 2,000 to 10,000, more preferably from 4,000 to 7,000 and most preferably from 4,000 to 5,000. Water-soluble salts of such acrylic/maleic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. The ratio of acrylate to maleate segments in such copolymers will generally range from 30:1 to 1:1, more preferably from 10:1 to 2:1. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Of these acrylic/maleic-based copolymers, the water-soluble salts of copolymers of acrylic acid and maleic acid are preferred.

Another class of polymeric polycarboxylic acid compounds suitable for use herein are the homo-polymeric polycarboxylic acid compounds derived from acrylic acid. The average molecular weight of such homo-polymers in the acid form preferably ranges from 2,000 to 100,000, more preferably from 3,000 to 75,000, most preferably from 4,000 to 65,000.

A further example of polymeric polycarboxylic compounds which may be used herein include the maleic/acrylictvinyl alcohol terpolymers. Such materials are also disclosed in EP 193,360, including, for example, the 45/45/10 terpolymer of acrylic/maleic/vinyl alcohol.

Another example of polymeric polycarboxylic compounds which may be used herein include the biodegradable polyaspartic acid and polyglutamic acid compounds.

Conventional Detersive Adjuncts

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Clay Soil Removal/Anti-redeposition Agents—The compositions according to the present invention can also optionally contain water-soluble ethoxylated amines having clay soil removal and antiredeposition properties. Granular detergent compositions which contain these compounds typically contain from 0.01% to 10.0% by weight of the water-soluble ethoxylates amines; liquid detergent compositions typically contain 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in EP 111,965. Other clay soil removal/antiredeposition agents which can be used include the ethoxylated amine polymers disclosed in EP 111,984; the zwitterionic polymers disclosed in EP 112,592; and the amine oxides disclosed in U.S. Pat. No. 4,548,744. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Soil Release Agent—Any polymeric soil release agent known to those skilled in the art can optionally be employed in the compositions and processes of this invention. Polymeric soil release agents are characterised by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units wherein said mixture contains a suffi- cient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_n OCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow) and carboxy alkyl of cellulose such as Metolose (Shin Etsu). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft copolymers of poly (vinyl ester), e.g., $C_1$–$C_{16}$ vinyl esters, preferably poly(vinyl acetate) grafted onto polyalkylene oxide backbones, such as polyethylene oxide backbones (see EP 0 219 048). Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 to Hays and U.S. Pat. No. 3,893,929.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580 and the block polyester oligomeric compounds of U.S. Pat. No. 4,702,857.

Preferred polymeric soil release agents also include the soil release agents of U.S. Pat. No. 4,877,896, which discloses anionic, especially sulfoarolyl, end-capped terephthalate esters.

If utilized, soil release agents will generally comprise from 0.01% to 10.0%, by weight, of the compositions herein, typically from 0.1% to 5%, preferably from 0.2% to 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulfonate. Said soil release agent also comprises from 0.5% to 20%, by weight of the oligomer, of a crystalline-reducing stabilizer, preferably selected from xylene sulfonate, cumene sulfonate, toluene sulfonate, and mixtures thereof.

Dye Transfer Inhibiting Agents

The compositions according to the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

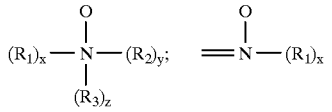

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the compositions herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization".) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinyl-pyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1.2% by weight of such optical brighteners.

The hydrophilic optical brighteners useful in the present invention are those having the structural formula:

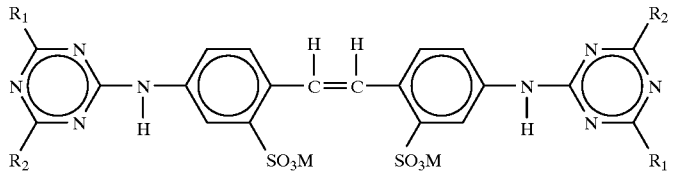

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Other spic optical brightener species which may be used in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other conventional optical brightener types of compounds can optionally be used in the present compositions to provide conventional fabric "brightness" benefits, rather than a true dye transfer inhibiting effect. Such usage is conventional and well-known to detergent formulations.

Conventional optical brighteners or other brightening or whitening agents known in the art can be incorporated at levels typically from 0.005% to 5%, preferably from 0.01% to 1.2% and most preferably from 0.05% to 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brightener which may also be used in the present invention indude naphthalimide, benzoxazole, benzofuran, benzimidazole and any mixtures thereof.

Specific examples of optical brighteners which are useful in the present compositions are those identified in U.S. Pat. No. 4,790,856. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins. Specific examples of these brighteners include 4-methyl-7-diethyl- amino coumarin; 1,2-bis(-benzimidazol-2-yl)ethylene; 1,3-diphenyl-pyrazolines; 2,5-bis(benzoxazol-2-yl)thiophene; 2-styryl-naptho-[1,2-d] oxazole; and 2-(stilbene-4-yl)-2H-naphtho[1,2-d]triazole. See also U.S. Pat. No. 3,646,015.

Suds Suppressors—Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347. The monocarboxylic fatty adds and salts thereof used as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of −40° C. and 50° C., and a minimum boiling point not less than 110° C. (atmospheric pressure). It is also known to utilize waxy hydrocarbons, preferably having a melting point below 100° C. The hydrocarbons constitute a preferred category of suds suppressor for detergent compositions. Hydrocarbon suds suppressors are described, for example, in U.S. Pat. No. 4,265,779. The hydrocarbons, thus, include aliphatic, alicyclic, aromatic, and heterocyclic saturated or unsaturated hydrocarbons having from 12 to 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779 and EP 354016.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672 and in U.S. Pat. No. 4,652,392.

An exemplary silicone based suds suppressor for use herein is a suds suppressing amount of a suds controlling agent consisting essentially of:

(i) polydimethylsiloxane fluid having a viscosity of from 20 cs. to 1,500 cs. at 25° C.;

(ii) from 5 to 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from 0.6:1 to 1.2:1; and (iii) from 1 to 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from 0.001 to 1, preferably from 0.01 to 0.7, most preferably from 0.05 to 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than 2 weight %; and without polypropylene glycol. Similar amounts can be used in granular compositions, gels, etc. See also U.S. Pat. Nos. 4,978,471 and 4,983,316; 5,288,431 and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than 1,000, preferably between 100 and 800. The polyethylene glycol and polyethylene/polypropylene copolymers herein have a solubility in water at room temperature of more than 2 weight %, preferably more than 5 weight %.

The preferred solvent herein is polyethylene glycol having an average molecular weight of less than 1,000, more preferably between 100 and 800, most preferably between 200 and 400, and a copolymer of polyethylene glycol/polypropylene glycol, preferably PPG 200/PEG 300. Preferred is a weight ratio of between 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to 5% of suds suppressor. When utilized as suds suppressors, monocarboxylic fatty acids, and salts therein, will be present typically in amounts up to 5%, by weight, of the detergent composition. Preferably, from 0.5% to 3% of fatty monocarboxylate suds suppressor is utilized. Silicone suds suppressors are typically utilized in amounts up to 2.0%, by weight, of the detergent composition, although higher amounts may be used. This upper limit is practical in nature, due primarily to concern with keeping costs minimized and effectiveness of lower amounts for effectively controlling sudsing. Preferably from 0.01% to 1% of silicone suds suppressor is used, more preferably from 0.25% to 0.5%. As used herein, these weight percentage values include any silica that may be utilized in combination with polyorganosiloxane, as well as any adjunct materials that may be utilized. Monostearyl phosphate suds suppressors are generally utilized in amounts ranging from 0.1% to 2%, by weight, of the composition. Hydrocarbon suds suppressors are typically utilized in amounts ranging from 0.01% to 5.0%, although higher levels can be used. The alcohol suds suppressors are typically used at 0.2%–3% by weight of the finished compositions.

Fabric Softeners—Various through-the-wash fabric softeners, especially the impalpable smectite clays of U.S. Pat. No. 4,062,647, as well as other softener clays known in the art, can optionally be used typically at levels of from 0.5% to 10%, preferably from 0.5% to 2% by weight in the present compositions to provide fabric softener benefits concurrently with fabric cleaning. Clay softeners can be used in combination with amine and cationic softeners as disclosed, for example, in U.S. Pat. No. 4,375,416 and U.S. Pat. No. 4,291,071.

Other Ingredients—A wide variety of other functional ingredients useful in detergent compositions can be included in the compositions herein, including other active ingredients, carriers, hydrotropes, processing aids, dyes or pigments, solvents for liquid formulations, solid fillers for bar compositions. The detergent compositions herein will preferably be formulated such that, during use in aqueous cleaning operations, the wash water will have a pH of between 6.5 and 11, preferably between 7.5 and 10.5. Laundry products are typically at pH 9–11. Techniques for controlling pH at recommended usage levels include the use of buffers, alkalis, acids, etc., and are well known to those skilled in the art.

Other Optional Ingredients

Other optional ingredients suitable for inclusion in the compositions of the invention include perfumes, colours and filler salts, with sodium sulfate being a preferred filler salt.

Form of the Compositions

The detergent compositions of the invention can be formulated in any desirable form such as powders, granulates, pastes, liquids, and gels.

Liquid Compositions

The detergent compositions of the present invention may be formulated as liquid detergent compositions. Such liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel Compositions

The detergent compositions of the present invention may also be in the form of gels. Such compositions are typically formulated with polyakenyl polyether having a molecular weight of from about 750,000 to about 4,000,000.

Solid Compositions

The detergent compositions of the invention may also be in the form of solids, such as powders and granules.

Preferably, the mean particle size of the components of granular compositions in accordance with the invention should be such that no more that 5% of particles are greater than 1.4 mm in diameter and not more than 5% of particles are less than 0.1 5 mm in diameter.

The term mean particle size as defined herein is determined by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

The bulk density of granular detergent compositions in accordance with the present invention are particularly useful in concentrated granular detergent compositions that are characterised by a relatively high density in comparison with conventional laundry detergent compositions. Such high density compositions typically have a bulk density of at least 400 g/liter, more preferably from 650 g/liter to 1200 g/liter, most preferably from 800 g/liter to 1000 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg; a knife, across its upper edge. The filled cup is then weighed and the value obtained for the weight of powder doubled to provide a bulk density in g/liter. Replicate measurements are made as required.

Making Processes—Granular Compositions

In general, granular detergent compositions in accordance with the present invention can be made via a variety of methods including dry mixing, spray drying, agglomeration and granulation.

The invention is illustrated in the following non limiting examples, in which all percentages are on a weight basis unless otherwise stated.

In the detergent compositions of the invention, the abbreviated component identifications have the following meanings:

LAS: Sodium linear $C_{12}$ alkyl benzene sulphonate

TAS: Sodium tallow alcohol sulphate

C45AS: Sodium $C_{14}$–$C_{15}$ linear alkyl sulphate

CxyEzS: Sodium $C_{1x}$–$C_{1y}$ branched alkyl sulphate condensed with z moles of ethylene oxide C45E7: A $C_{14-15}$ predominantly linear primary alcohol condensed with an average of 7 moles of ethylene oxide C25 E3: A $C_{12-15}$ branched primary alcohol condensed with an average of 3 moles of ethylene oxide C25E5: A $C_{12-15}$ branched primary alcohol condensed with an average of 5 moles of ethylene oxide QAS: $R_2.N^+(CH_3)_2(C_2H_4OH)$ with $R_2=C_{12}$–$C_{14}$ CEQ: $R_1COOCH_2CH_2.N^+(CH_3)_3$ with $R_1=C_{11}$–$C_{13}$ Soap: Sodium linear alkyl carboxylate derived from an 80/20 mixture of tallow and a coconut oils.

TFAA: $C_{16}$–$C_{18}$ alkyl N-methyl glucamide

TPKFA: $C_{12}$–$C_{14}$ topped whole cut fatty acids

STPP: Anhydrous sodium tripolyphosphate

Zeolite A: Hydrated Sodium Aluminosilicate of formula $Na_{12}(A10_2SiO_2)_{12}.27H_2O$ having a primary particle size in the range from 0.1 to 10 micrometers NaSKS-6: Crystalline layered silicate of formula δ—$Na_2Si_2O_5$ Citric acid: Anhydrous citric acid Carbonate: Anhydrous sodium carbonate with a particle size between 200μm and 900 μm Bicarbonate: Anhydrous sodium bicarbonate with a particle size distribution between 400 μm and 1200 μm Silicate: Amorphous Sodium Silicate ($SiO_2$:$Na_2O$; 2.0 ratio)

Sulphate: Anhydrous sodium sulphate

Citrate: Tri-sodium citrate dihydrate of activity 86.4% with a particle size distribution between 425 μm and 850 μm MA/AA: Copolymer of 1:4 maleic/acrylic acid, average molecular weight about 70,000.

CMC: Sodium carboxymethyl cellulose

Savinase: Proteolytic enzyme of activity 4 KNPU/g

Alcalase: Proteolytic enzyme of activity 3 AU/g

Carezyme: Cellulytic enzyme of activity 1000 CEVU/g

Termamyl: Amylolytic enzyme of activity 60 KNU/g

Lipolase: Lipolytic enzyme of activity 100 kLU/g

Endolase: Endoglunase enzyme of activity 3000 CEVU/g all sold by NOVO Industries A/S and of activity mentioned above unless otherwise specified PB4: Sodium perborate tetrahydrate of nominal formula $NaBO_2.3H_2O.H_2O_2$ PB1: Anhydrous sodium perborate bleach of nominal formula $NaBO_2.H_2O_2$ Percarbonate: Sodium Percarbonate of nominal formula $2Na_2CO_3.3H_2O_2$ NOBS: Nonanoyloxybenzene sulfonate in the form of the sodium salt.

TAED: Tetraacetyl ethylene diamine

DTPMP: Diethylene triamine penta (methylene phosphonate), marketed by Monsanto under the Trade name Dequest 2060

Photoactivated: Sulphonated Zinc Phthalocyanin encapsulated in bleach dextrin soluble polymer Brightener 1: Disodium 4,4'-bis(2-sulphostyryl)biphenyl Brightener 2: Disodium 4,4'-bis(4-anilino-6-morpholino-1.3.5-triazin-2-yl)amino) stilbene-2:2'-disulphonate.

HEDP: 1,1-hydroxyethane diphosphonic acid

PVNO: Polyvinylpyridine N-oxide

PVPVI: Copolymer of polyvinylpyrolidone and vinylimidazole

SRP 1: Sulfobenzoyl end capped esters with oxyethylene oxy and terephtaloyl backbone SRP 2: Diethoxylated poly (1, 2 propylene terephtalate) short block polymer Silicone antifoam: Polydimethyidiloxane foam controller with Siloxane-oxyalkylene copolymer as dispersing agent with a ratio of said foam controller to said dispersing agent of 10:1 to 100:1.

EXAMPLE 1

Comparative Performance Testing

The following formulations were prepared, where A is a prior art formulation and B is according to the invention.

| Components (% by weight) | A | B |
|---|---|---|
| LAS | 8.0 | 8.0 |
| C25E3 | 3.4 | 3.4 |
| CEQ | — | 0.7 |
| Zeolite | 18.10 | 18.10 |
| Carbonate | 22.50 | 22.50 |
| Silicate | 2.50 | 2.50 |
| Na Sulphate | 26.11 | 26.11 |
| MA/AA | 0.30 | 0.30 |
| CMC | 0.22 | 0.22 |
| Savinase | 0.85 | 0.85 |
| Termamyl | 0.10 | 0.10 |
| PB4 | 9.0 | 9.0 |
| TAED | 1.50 | 1.50 |
| DTPMP | 0.25 | 0.25 |
| $MgSO_4$ | 0.30 | 0.30 |
| Photoactivated bleach | 15 ppm | 15 ppm |
| Suds suppressor | 0.55 | 0.55 |
| Brightener 1 | 0.09 | 0.09 |
| Perfume | 0.26 | 0.26 |
| HEDP | 0.22 | 0.22 |
| Miscellaneous to balance | | |

Test Protocol—Stain Removal

Three white cotton sheets were prewashed in a non-biological bleach-free heavy duty detergent to remove any fabric finish employed by the textile manufacturer. Blood stains (provided by the EMPA Institute) were then evenly applied using a paintbrush to one sheet, egg stains to the second sheet and chocolate stains to the third one. The stains were then left to dry overnight. Sets of six test swatches of size 4 cm×4 cm were cut from each sheet.

The sets of stained fabric swatches were subjected to one wash cycle in an automatic washing machine. The swatches were then assessed for removal of the various proteinaceous stains by a four person grading panel using the well-known four-point Scheffe scale.

In more detail, a Miele 820 automatic washing machine was employed, and the 40° C. short cycle programme selected. Water of 10° Clark hardness (=1.5 mmol $Ca^{2+}$/liter) was used. 100 g of detergent, dispensed from a granulette dispensing device was employed. One swatch of each fabric type was washed along with a ballast load of 5 lbs (approx 2.4 Kg) of lightly soiled sheets consisting of a 60%/40% mixture of synthetic and cotton fabrics.

Comparative Testing—Results

The above stain removal test protocol was followed in comparing the efficiency of the two different Compositions A and B in removing proteinaceous soils.

The results, averaged over all of the proteinaceous soils types, obtained were as follows:

| Components | A (reference) | B |
|---|---|---|
| Ratio anionic surfactant :Protease | 9.4 | 9.4 |
| Ratio anionic:CEQ surfactant | — | 11.4 |
| CEQ surfactant: wt % of total surfactant system | — | 5.8 |
| Stain removal performance (PSU) | 0.0 | +1.0s |

s = significant at 95% confidence level

The stain removal obtained for Composition B is thus shown to be enhanced over the reference Formulation A.

EXAMPLE 2

The following laundry detergent compositions C, D and E according to the present invention were prepared.

| Components (% by weight) | C | C | E |
|---|---|---|---|
| LAS | 5.25 | 5.61 | 4.76 |
| TAS | 1.25 | 1.86 | 1.57 |
| C45AS | — | 2.24 | 3.89 |
| AE3S | — | 0.76 | 1.18 |
| C25E5 | — | 5.47 | — |
| C45E7 | 3.25 | — | 5.0 |
| CEQ | 0.55 | 2.0 | 2.0 |
| STPP | 19.7 | — | — |
| Zeolite | — | 19.52 | 19.52 |
| SKS-6 | — | 8.21 | 8.21 |
| Citric acid | — | 2.24 | 2.24 |
| Carbonate | 6.10 | 21.44 | 21.44 |
| Bicarbonate | — | 2.0 | 2.0 |
| Silicate | 6.80 | — | — |
| Sulphate | 39.74 | — | 14.3 |
| MA/AA | 0.80 | 1.65 | 1.65 |
| CMC | 0.20 | 0.36 | 0.36 |
| Savinase | 0.85 | 2.75 | 2.75 |
| Termamyl | 0.09 | 0.13 | 0.13 |
| PB4 | 5.0 | 12.67 | — |
| TAED | 0.50 | 3.13 | — |
| DTPMP | 0.25 | 0.20 | 0.20 |
| $MgSO_4$ | 0.35 | 0.20 | 0.20 |
| Photoactivated bleach | 15 ppm | 27 ppm | 27 ppm |
| Suds suppressor | 0.48 | 2.4 | 2.4 |

-continued

| Components (% by weight) | C | C | E |
|---|---|---|---|
| Brightener 1 | 0.08 | 0.23 | 0.23 |
| Perfume | 0.26 | 0.47 | 0.47 |
| HEDP | — | 0.27 | 0.27 |
| Miscellaneous to balance | | | |

EXAMPLE 3

The following detergent formulations, according to the present invention were prepared, where formulation F is a phosphorus-containing detergent composition, formulation G is a zeolite-containing detergent composition and formulation H is a compact detergent composition:

| | F | G | H |
|---|---|---|---|
| Blown Powder | | | |
| STPP | 24 | — | 24.0 |
| Zeolite A | — | 24.0 | — |
| Sulphate | 9.0 | 6.0 | 13.0 |
| MA/AA | 2.0 | 4.0 | 2.0 |
| LAS | 6.0 | 8.0 | 11.0 |
| TAS | 2.0 | — | — |
| CEQ | 0.7 | 0.7 | 2.0 |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 6.0 | 13.0 | 15.0 |
| PB4 | 18.0 | 18.0 | 10.0 |
| PB1 | 4.0 | 4.0 | — |
| TAED | 3.0 | 3.0 | 1.0 |
| Photoactivated bleach | 0.02% | 0.02% | 0.02% |
| Savinase | 1.0 | 1.0 | 1.0 |
| Lipolase | 0.4 | 0.4 | 0.4 |
| Termamyl | 0.25 | 0.30 | 0.15 |
| Sulphate | 3.0 | 3.0 | 5.0 |
| Balance (Moisture & Miscellaneous) | 100.0 | 100.0 | 100.0 |
| Density (g/litre) | 630 | 670 | 670 |

EXAMPLE 4

The following nil bleach-containing detergent formulations I to K of particular use in the washing of colored clothing, according to the present invention were prepared:

| | I | J | K |
|---|---|---|---|
| Blown Powder | | | |
| Zeolite A | 15.0 | 15.0 | — |
| Sulphate | 0.0 | 5.0 | — |
| LAS | 3.0 | 3.0 | — |
| CEQ | 2.0 | 1.5 | 1.3 |
| DTPMP | 0.4 | 0.5 | — |
| CMC | 0.4 | 0.4 | — |
| MA/AA | 4.0 | 4.0 | — |

-continued

| | I | J | K |
|---|---|---|---|
| Agglomerates | | | |
| C45AS | — | — | 11.0 |
| LAS | 6.0 | 5.0 | — |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 8.0 | 5.0 | 7.0 |
| PVPVI/PVNO | 0.5 | 0.5 | 0.5 |
| Alcalase | 0.5 | 0.3 | 0.9 |
| Lipolase | 0.4 | 0.4 | 0.4 |
| Termamyl | 0.6 | 0.6 | 0.6 |
| Carezyme | 0.6 | 0.6 | 0.6 |
| Silicone antifoam | 5.0 | 5.0 | 5.0 |
| Sulphate | — | 9.0 | — |
| Balance (Moisture and Miscellaneous) | 100.0 | 100.0 | 100.0 |
| Density (g/litre) | 700 | 700 | 700 |

EXAMPLE 5

The following detergent formulations L to O, according to the present invention were prepared:

| | L | M | N | O |
|---|---|---|---|---|
| LAS | 20.0 | 14.0 | 24.0 | 22.0 |
| QAS | 0.7 | 1.0 | — | 0.7 |
| TFAA | — | 1.0 | — | — |
| C25E5/C45E7 | — | 2.0 | — | 0.5 |
| C45E3S | — | 2.5 | — | — |
| CEQ | 2.0 | 1.5 | 1.0 | 1.0 |
| STPP | 30.0 | 18.0 | 30.0 | — |
| Silicate | 9.0 | 5.0 | 10.0 | — |
| Carbonate | 13.0 | 7.5 | — | 5.0 |
| Bicarbonate | — | 7.5 | — | — |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Savinase | 0.8 | 1.0 | 0.5 | 0.5 |
| Termamyl | 0.8 | 0.4 | — | 0.25 |
| Lipolase | 0.2 | 0.1 | 0.2 | 0.1 |
| Carezyme (5T) | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| PB1 | 6.0 | 2.0 | — | — |
| NOBS | 2.0 | 1.0 | — | — |
| Balance (Moisture and Miscellaneous) | 100.0 | 100.0 | 100.0 | 100.0 |

EXAMPLE 6

The following detergent formulations P to R, according to the present invention were prepared:

| | P | Q | R |
|---|---|---|---|
| Blown Powder | | | |
| Zeolite A | 30.0 | 22.0 | 6.0 |
| Sulphate | 19.0 | 10.0 | 7.0 |
| MA/AA | 3.0 | 3.0 | 6.0 |
| LAS | 14.0 | 12.0 | 22.0 |
| C45AS | 8.0 | 7.0 | 7.0 |
| CEQ | 2.0 | 2.0 | 2.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| DTPMP | — | 0.4 | 0.4 |
| Spray On | | | |
| C45E7 | 1.0 | 1.0 | 1.0 |
| Dry additives | | | |
| PVPVI/PVNO | 0.5 | 0.5 | 0.5 |
| Savinase | 1.0 | 1.0 | 1.0 |
| Lipolase | 0.4 | 0.4 | 0.4 |
| Termamyl | 0.1 | 0.1 | 0.1 |
| Carezyme | 0.1 | 0.1 | 0.1 |
| NOBS | — | 6.1 | 6.0 |
| PB1 | 1.0 | 5.0 | 6.0 |
| Sulphate | — | 6.0 | — |
| Balance (Moisture and Miscellaneous) | 100.0 | 100.0 | 100.0 |

EXAMPLE 7

The following high density (850 g/liter) and bleach-containing detergent formulations S to U, according to the present invention were prepared:

| | S | T | U |
|---|---|---|---|
| Blown Powder | | | |
| Zeolite A | 15.0 | 15.0 | 15.0 |
| Sulphate | 0.0 | 5.0 | 0.0 |
| LAS | 3.0 | 3.0 | 3.0 |
| QAS | — | 1.5 | 1.5 |
| CEQ | 2.0 | 1.5 | 2.0 |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 2.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| TAED | 6.0 | 2.0 | 5.0 |
| PB1 | 14.0 | 7.0 | 10.0 |
| Polyethylene oxide of MW 5,000,000 | — | — | 0.2 |
| Bentonite | — | — | 10.0 |
| Savinase | 1.0 | 1.0 | 1.0 |
| Lipolase | 0.4 | 0.4 | 0.4 |
| Termamyl | 0.6 | 0.6 | 0.6 |
| Carezyme | 0.6 | 0.6 | 0.6 |
| Silicone antifoam granule | 5.0 | 5.0 | 5.0 |

-continued

| | S | T | U |
|---|---|---|---|
| Sulphate | 0.0 | 3.0 | 0.0 |
| Balance (Moisture and Miscellaneous) | 100.0 | 100.0 | 100.0 |

EXAMPLE 8

The following high density detergent formulations V and W, according to the present invention were prepared:

| | V | W |
|---|---|---|
| Agglomerate | | |
| C45AS | 11.0 | 14.0 |
| CEQ | 3 | 3.5 |
| Zeolite A | 15.0 | 6.0 |
| Carbonate | 4.0 | 8.0 |
| MA/AA | 4.0 | 2.0 |
| CMC | 0.5 | 0.5 |
| DTPMP | 0.4 | 0.4 |
| Spray On | | |
| C25E5 | 5.0 | 5.0 |
| Perfume | 0.5 | 0.5 |
| Dry Additives | | |
| HEDP | 0.5 | 0.3 |
| SKS 6 | 13.0 | 10.0 |
| Citrate | 3.0 | 1.0 |
| TAED | 5.0 | 7.0 |
| PC | 20.0 | 20.0 |
| SRP 1 | 0.3 | 0.3 |
| Savinase | 1.4 | 1.4 |
| Lipolase | 0.4 | 0.4 |
| Carezyme | 0.6 | 0.6 |
| Termamyl | 0.6 | 0.6 |
| Silicone antifoam particle | 5.0 | 5.0 |
| Brightener 1 | 0.2 | 0.2 |
| Brightener 2 | 0.2 | — |
| Balance (Moisture and Miscellaneous) | 100 | 100 |
| Density (g/litre) | 850 | 850 |

EXAMPLE 9

The following liquid detergent formulations X to AE, according to the present invention were prepared:

| | X | Y | Z | AA | AB | AC | AD | AE |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| QAS | — | — | — | — | 3.0 | 1.0 | — | — |
| CEQ | 0.6 | 1.5 | 1.0 | 0.75 | 2.0 | 1.5 | 1.8 | 2.0 |
| TPKFA | 2.0 | — | 13.0 | 2.0 | — | 15 | 7.0 | 7.0 |
| Rapeseed fatty acids | — | — | — | 5.0 | — | — | 4.0 | 4.0 |
| Citric acid | 2.0 | 3.0 | 1.0 | 1.5 | 1.0 | 1.0 | 1.0 | 1.0 |
| Dodecenyl/tetra-decenyl succinic acid | 12.0 | 10.0 | — | — | 15.0 | — | — | — |
| Oleic acid | 4.0 | 2.0 | 1.0 | — | 1.0 | — | — | — |
| Ethanol | 4.0 | 4.0 | 7.0 | 2.0 | 7.0 | 2.0 | 3.0 | 2.0 |
| 1,2 Propane-diol | 4.0 | 4.0 | 2.0 | 7.0 | 6.0 | 8.0 | 10.0 | 13.0 |
| Mono Ethanol Amine | — | — | — | 5.0 | — | — | 9.0 | 9.0 |
| Tri Ethanol Amine | — | — | 8.0 | — | — | — | — | — |
| NaOH up to pH | 8.0 | 8.0 | 7.6 | 7.7 | 8.0 | 7.5 | 8.0 | 8.2 |
| Ethoxylated tetra-ethylene pentamine | 0.5 | — | 0.5 | 0.2 | — | — | 0.4 | 0.3 |
| DTPMP | 1.0 | 1.0 | 0.5 | 1.0 | 2.0 | 1.2 | 1.0 | — |
| SRP 2 | 0.3 | — | 0.3 | 0.1 | — | — | 0.2 | 0.1 |
| PVNO | — | — | — | — | — | — | — | 0.10 |
| Protease | 0.5 | 0.5 | 0.4 | 0.25 | — | 0.5 | 0.3 | 0.6 |
| Alcalase | — | — | — | — | 1.5 | — | — | — |
| Lipolase (109 KLU/g) | — | 0.10 | — | 0.01 | — | — | 0.15 | 0.15 |
| Termamyl (300 KNU/g) | 0.05 | 0.05 | 0.12 | 0.10 | 0.05 | 0.15 | 0.10 | 0.10 |
| Carezyme (5000 CEVU/g) | — | — | — | 0.01 | — | — | 0.03 | 0.03 |
| Endoglucanase | — | — | — | 0.10 | — | — | 0.07 | — |
| Boric acid | 0.1 | 0.2 | — | 2.0 | 1.0 | 1.5 | 2.5 | 2.5 |
| Na formate | — | — | 1.0 | — | — | — | — | — |
| Calcium chloride | — | 0.015 | — | 0.01 | — | — | — | — |
| Softening clay of the bentonite type | — | — | — | — | 4.0 | 4.0 | — | — |
| Balance (Moisture and Miscellaneous) | 100.0 | 100.0 | 100.0 | 100.0 | 100.0 | 100.0 | 100.0 | 100.0 |

What is claimed is:

1. A detergent composition comprising:

a) from 1% to 95% by weight of a surfactant system comprising an anionic surfactant which includes a linear alkyl benzene sulfonate and a cationic ester surfactant, selected from the group consisting of stearoyl choline ester quaternary methylammonium halides, palmitoyl choline ester quaternary methylammonium halides, myristoyl choline ester quaternary methylammonium halides, lauroyl choline ester quaternary methylammonium halides, cocoyl choline ester quaternary methylammonium halides, tallowyl choline ester quaternary methylammonium halides, and mixtures, present in a weight ratio of said anionic surfactant to said cationic ester surfactant of 2.5:1 to 25:1;

b) from 0.0001% to 5% by weight of a proteolytic enzyme; and c) from 0.0001% to 5% by weight of an amylolytic enzyme;

wherein the % weight of proteolytic enzyme in the formulation is based on an enzyme activity of 4 Knpu/g of the enzyme particle, and wherein the weight ratio of said anionic surfactant to said proteolytic enzyme is at least 1.5:1.

2. A detergent composition according to claim 1, wherein said surfactant system is present in amount from about 3% to about 50% by weight of the detergent composition.

3. A detergent composition according to claim 2, wherein the weight ratio of said anionic surfactant to said cationic ester surfactant in the surfactant system is from about 4:1 to about 15:1.

4. A detergent composition according to claim 1, wherein said cationic ester surfactant is cocoyl choline ester quaternary methylammonium halide.

5. A detergent composition according to claim 1, wherein said proteolytic enzyme is selected from the group consisting of protease enzymes derived from *Bacillus lentus, Bacillus licheniformis, Bacillus amyloliquefaciens* and mixtures thereof.

6. A detergent composition according to claim 5, wherein said surfactant system is present in amount from about 4% to about 40% by weight of the detergent composition.

7. A detergent composition according to claim 6, wherein the weight ratio of said anionic surfactant to said cationic ester surfactant in the surfactant system is from about 5:1 to about 10:1.

8. A detergent composition comprising:

a) from about 1% to 95% by weight of a surfactant system comprising an anionic surfactant which includes a linear alkyl benzene sulfonate and a cationic ester surfactant, selected from the group consisting of stearoyl choline ester quaternary methylammonium halides, palmitoyl choline ester quaternary methylammonium halides, myristoyl choline ester quaternary methylammonium halides, lauroyl choline ester methylammonium halides, cocoyl choline ester quaternary methylammonium halides, tallowyl choline ester quaternary methylammonium halides, and mixtures thereof present in a weight ratio of said anionic surfactant to said cationic ester surfactant of 2.5:1 to 25:1;

b) from 0.001% to 4% by weight of a proteolytic enzyme; and c) from 0.0001% to 5% by weight of an amylolytic enzyme;

wherein the % weight of proteolytic enzyme in the formulation is based on an enzyme activity of 4 Knpu/g of the enzyme particle, and wherein the weight ratio of said anionic surfactant to said proteolytic enzyme is at least 1.5:1.

9. A detergent composition according to claim 8, wherein said proteolytic enzyme is in amount from about 0.005% to about 2% by weight of the composition.

10. A detergent composition according to claim 9, wherein the weight ratio of said anionic surfactant to said proteolytic enzyme is at least 3:1.

11. A detergent composition according to claim 10, wherein the weight ratio of said anionic surfactant to said proteolytic enzyme is at least 5:1.

12. A detergent composition according to claim 11, wherein said proteolytic enzyme is selected from the group consisting of protease enzymes derived from *Bacillus lentus, Bacillus licheniformis, Bacillus amyloliquefaciens* and mixtures thereof.

13. A detergent composition according to claim 12, wherein said cationic ester surfactant is cocoyl choline ester quaternary methylammonium halide.

14. A detergent composition according to claim 13, wherein said detergent composition further comprises one or more additional enzymes present at a level of about 0.0001% to about 5% by weight of the composition.

15. A detergent composition according to claim 14, wherein said additional enzymes are selected from the group consisting of cellulase, lipase, peroxidase, endoglucanase enzymes and mixtures thereof.

16. A detergent composition according to claim 8, wherein said amylolytic enzyme is an α-amylase.

17. A detergent composition according to claim 16 wherein said α-amylase is derived from *Bacillus licheniformis*.

* * * * *